United States Patent [19]

Schaller

[11] Patent Number: 4,748,889

[45] Date of Patent: Jun. 7, 1988

[54] MACHINE HEAD

[76] Inventor: Rene K. F. Schaller, Kellerstr. 18, 8508 Wendelstein, Fed. Rep. of Germany

[21] Appl. No.: 35,463

[22] Filed: Apr. 7, 1987

[51] Int. Cl.[4] ..... G10D 3/14

[52] U.S. Cl. ..... 84/304; 84/297 R

[58] Field of Search ..... 84/297 R, 304–306

[56] References Cited

U.S. PATENT DOCUMENTS 310,590 1/1885 Hyde ..... 84/306

554,057 2/1896 Durkee ..... 84/304

*Primary Examiner*—Lawrence R. Franklin

*Attorney, Agent, or Firm*—McCormick, Paulding & Huber

[57] ABSTRACT

A machine head for use with a guitar or other stringed musical instrument has a rotatable peg with a string receiving transverse hole. An axial bore extends from the free end of the peg to the transverse hole and receives a clamping member movable axially in the bore into and out of clamping relation with the string in the transverse hole. Manual rotation of a part threaded onto the outer end portion of the peg produces the axial clamping or releasing motion of the clamping member.

6 Claims, 1 Drawing Sheet

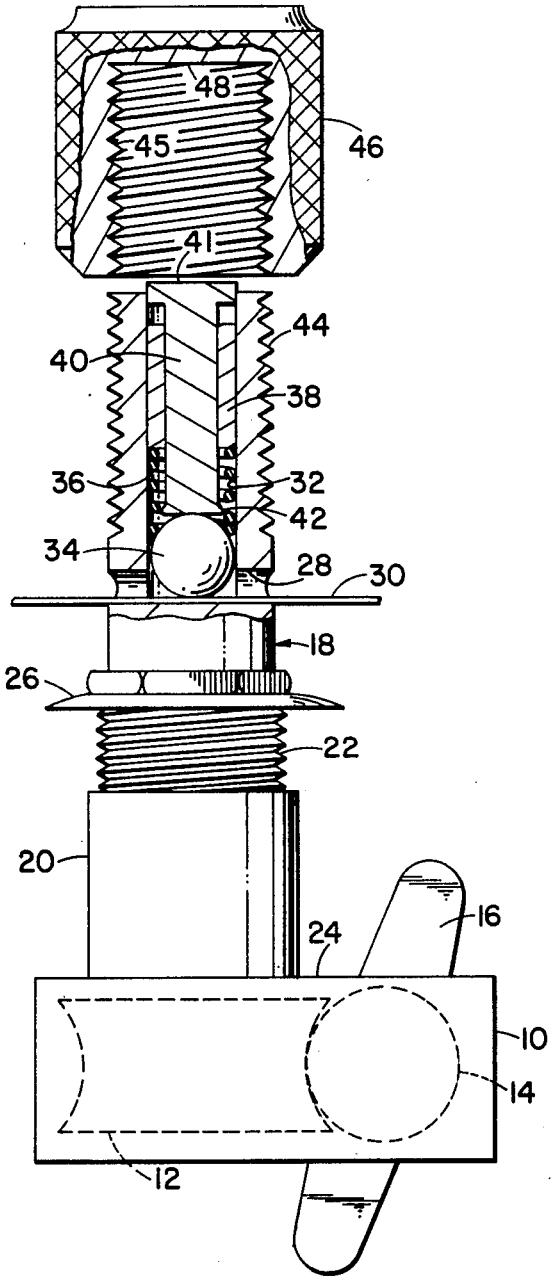
48
45
46
41
44
40
38
36
32
42
34
28
30
18
26
22
20
16
24
10
14
12

MACHINE HEAD

BACKGROUND OF THE INVENTION

This invention relates to a machine head for stringed musical instruments, and deals more particulary with a machine head having as its holding device a rotatable peg connected through a drive mechanism, such as worm gearing, to a manually operable handle, the peg having a transverse hole normal to its longitudinal axis for the passing through of a string.

In conventional machine heads of the above described kind, for example as used on guitars, a string in tight condition usually winds around the peg of its associated machine head with several windings. After a certain tuning tension is reached, the string winds around the peg so tightly that it cannot slide and the tuning tension is maintained. However, on instruments which have a tremolo device, the string tension is released for short periods of time by using the tremolo device. In doing so, the windings around the peg may loosen and the string may slide slightly on the peg. That means, the string will not again reach its original tuning tension, and therefore not regain its original tuning, after releasing the tremolo device.

In order to eliminate this difficulty, there is already described a machine head in European patent application EP-A No. 2-0167512 in which a screw can be screwed in, in the axial direction from the free end of the peg, and wherein the string is bent around the threaded section of the screw and clamped between the screw head and the frontal end of the peg. Since the string is already stretched by hand when clamping by the screw, a small turn of the peg is subsequently enough to tension the string to the correct tone or pitch. When now using the tremolo device, even a reduction for a short time of the string tension cannot cause the string to slide and lose its tuning.

The disadvantage of this solution is that the clamp areas will produce friction on the string when tightening the screw so that the covering of the string can be damaged. A further danger is that during the tuning the string will squeeze into the slot between the two clamp areas, whereby it enters only gradually into the slot in this way that it will reach its final position according to the desired tuning. Finally, the clamping of the string is rather troublesome, since one has to be very careful that the string end, wound around the screw shaft, does not slip out between the clamp areas when the screw is tightened by one hand.

The object of the invention is to provide a machine head, of the above mentioned kind, allowing the safe clamping of a string by a most simple operation and without the danger of damaging the string.

SUMMARY OF THE INVENTION

According to the invention the above object is achieved in that the peg of a machine head has an axially directed bore, extending from its free end to a string receiving transverse hole and in which bore a thrust piece is received, which thrust piece is axially adjustable and which can be locked in clamped position relative to the string.

In the solution of the invention the string is put in the conventional way through the transverse hole of the peg and is pulled tight. Subsequently the string is clamped through the axial adjusting of a thrust piece, so that it cannot avoid the clamp pressure or slip out laterally between the clamp areas.

In the most simple case the thrust piece can be formed by a screw threaded into the axial bore of the peg. However, preferably the thrust piece comprises a pestle slidable axially in the axial bore, the peg having near its free end an end section provided with an external thread on which a blind nut can be screwed. The advantage of this latter solution is that, when the nut is tightened, the pestle is shifted axially only and is not turned, so that the pestle does not rub against or produce friction on the string. The danger is therefore reduced that the covering of the string will be damaged in this area, which could lead to a breaking of the string. The string is especially preserved if the pestle at its end which faces the string bore rests on a ball placed in the axial bore, so that only the ball has engagement with the string, and not the pestle.

In order not to be dependent on a wrench or a screw driver for tightening the nut, it is advisable that the nut have a knurling on its circumferential face, so the nut can be tightened by hand, and the formation of the thread on the peg and the nut as a relatively steep thread will allow a quick clamping of the string.

Further characteristics and advantages of the invention arise from the subclaims and the following description, which explains, in connection with the accompanying drawing, the invention according to a constructional example.

BRIEF DESCRIPTION OF THE DRAWING

The single FIGURE of the drawing is a partial schematic representation, and not a correct scale presentation, of a machine head according to the invention, the essential part of the peg and of the associated nut being shown in a vertical section containing the longitudinal axis of the peg.

DESCRIPTION OF THE PREFERRED EMBODIMENT

The machine head, shown in the FIGURE, comprises a housing 10 containing a worm gearing with a worm wheel 12 and a worm 14 fixed to an external handle 16 which is connected to the worm through a spindle (not shown) passing through the housing. The worm wheel 12 is fixed to a peg 18, which is rotatably received in a tubular shoulder 20 of the housing 10. The tubular shoulder 20 has an internal thread (not illustrated), into which a threaded bushing 22, provided with an external thread and surrounding the peg 18, can be screwed. By means of the threaded bushing the machine head can be attached to the non-illustrated neck of a stringed instrument, for example, a guitar, in which case the shoulder 20 is received in a bore in the guitar peg head and the involved piece of the peg head is clamped between the surface 24 of the housing 10 and a washer 26 surrounding the threaded bushing 22.

The free section of the peg 18, standing out from the threaded bushing 22, has at a certain distance from its free end a transverse hole or bore 28, which intersects the longitudinal axis of the peg, through which a string 30 can be drawn. From the free end of the peg 18 an axial bore 32 extends to the transverse hole 28. In the bore 32 is placed a ball 34, made preferably of hardened steel and having such a play that it can move freely in the axial bore 32. The ball 34 is urged in the direction toward the transverse hole 28 by means of a helical pressure spring placed in the bore 32, the spring 36 at its end remote from the ball bearing against a bushing 38 press fitted into the axial bore 32.

Slidably received in the bushing 38 is a pestle 40 which can be freely shifted axially relative to the bushing and which rests with its lower end on the ball 34 and which at its upper end stands out slightly from the axial bore 32 with an upper head 41. To prevent the pestle 40 from falling out of the bushing 38 the pestle 40 is provided with a radially outwardly extending edge 42 on its lower end.

On its end section, adjacent to its free end, the peg 18 has an external thread 44, formed with a relatively steep pitch, onto which a blind knurled nut 46, provided with a corresponding internal thread 45, can be screwed. When the nut 46 is screwed onto the peg 18, the bottom 48 of the threaded nut opening will press against the head 41 of the pestle 40, which extends out of the peg 18, and will shift the pestle axially downwardly, whereby the ball 34 will be pressed against the string 30 to fix it to the peg by clamping it between the ball 34 and the opposite wall portion of the transverse hole 28.

I claim:

1. A machine head for stringed musical instruments having as its string holding device a rotatable peg with a free end and with a transverse hole for receiving a string, and having a drive mechanism with a manually operable handle for rotating said peg, characterized by said peg having an axially directed bore extending from its free end to said transverse hole, a pestle axially slidably received in said axial bore, and an adjustment part threadably connected with said free end of said peg which adjustment part moves axially of said peg as it is rotated relative to said peg, said adjustment part having a portion which bears against said pestle to adjust the axial position of said pestle relative to said peg, and a ball received in said axial bore between said pestle and said transverse opening, said pestle having a lower end bearing against said ball.

2. A machine head for stringed musical instruments having as its string holding device a rotatable peg with a free end and with a transverse hole for receiving a string, and having a drive mechanism with a manually operable handle for rotating said peg, characterized by said peg having an axially directed bore extending from its free end to said transverse hole, a ball loosely received in said bore in the vicinity of said transverse hole so as to engage and lie above a string inserted through said transverse hole, and an adjustment means including one part threadably connected with said free end of said peg so as to move axially of said peg as it is rotated relative to said peg and including another part which bears against said ball and which is movable axially of said peg in response to the movement of said one part axially of said peg so that by rotation of said one part relative to said peg said ball may be brought into and out of clamping relationship with a string inserted through said transverse hole.

3. A machine head according to claim 2 further characterized by a spring in said bore cooperable with said ball for urging said ball downwardly toward engagement with a string inserted through said transverse hole.

4. A machine head for stringed musical instruments having as its string holding device a rotatable peg with a free end and with a transverse hole for receiving a string, and having a drive mechanism with a manually operable handle for rotating said peg, characterized by said peg having an axially directed bore extending from its free end to said transverse hole, a pestle axially slidably received in said axial bore, said peg near its free end having a section provided with an external thread, said pestle having an upper end extending from said free end of said peg, a blind nut having a blind opening with an internal thread threaded onto said end section of said peg and having a bottom surface in said blind opening engageable with said upper end of said pestle, and a ball received in said axial bore between said pestle and said transverse opening, said pestle having a lower end bearing against said ball so that by axial adjustment of said pestle brought about by rotation of said blind nut said ball may be brought into and out of clamped relationship to a string received in said transverse hole.

5. A machine head according to claim 4 further characterized by a bushing fixed in said axial bore and slidably receiving said pestle, said bushing having a lower end spaced above said ball, and a helical pressure spring in said axial bore between said lower end of said bushing and said ball and urging said ball downwardly.

6. A machine head according to claim 5 further characterized in that said pestle extends downwardly beyond said lower end of said bushing and is prevented from moving upwardly out of said bushing by a radial shoulder formed on the lower end of said pestle.

* * * * *